United States Patent [19]

Muller et al.

[11] 4,418,257

[45] Nov. 29, 1983

[54] KEYBOARD SWITCH

[75] Inventors: Michael Muller, Newport Beach; Gary C. Butts, Huntington Beach, both of Calif.

[73] Assignee: The Keyboard Company, Garden Grove, Calif.

[21] Appl. No.: 323,550

[22] Filed: Nov. 23, 1981

[51] Int. Cl.[3] ..... H01H 3/12; H01H 13/52

[52] U.S. Cl. ..... 200/159 B; 200/346

[58] Field of Search ..... 200/159 B, 159 A, 5 A, 200/340

[56] References Cited

U.S. PATENT DOCUMENTS

| | | | |
|---|---|---|---|
| 3,780,237 | 12/1973 | Seeger et al. | 200/159 B |
| 3,879,593 | 4/1975 | Larson | 200/159 B |
| 3,932,722 | 1/1976 | Obata et al. | 200/340 |
| 3,973,091 | 8/1976 | Kaminski | 200/159 B |
| 4,129,758 | 12/1978 | Gilano et al. | 200/159 B |
| 4,163,125 | 7/1979 | Boulanger | 200/159 B |
| 4,180,711 | 12/1979 | Hirata et al. | 200/159 B |

FOREIGN PATENT DOCUMENTS

| | | | |
|---|---|---|---|
| 2280964 | 2/1976 | France | 200/5 A |
| 2284177 | 4/1976 | France | 200/159 B |

*Primary Examiner*—John W. Shepperd

*Attorney, Agent, or Firm*—Blakely, Sokoloff, Taylor & Zafman

[57] ABSTRACT

An improved switch assembly is disclosed having particular application as part of a key in a computer keyboard. The switch includes first and second pairs of spaced apart electrical contacts, the first pair extending above the second. A conductive and resilient diaphragm is disposed over both pairs of contacts physically contacting only the first. A deformable generally bell shaped actuator member is disposed over the diaphragm, the walls of the actuator member being tapered in thickness so as to buckle upon the application of a known vertical force. Actuator means are provided to deform the actuator member in response to the activation of the switch by a user, thereby forcing the diaphragm to physically contact the second electrical contact completing a circuit.

10 Claims, 7 Drawing Figures

Fig. 1
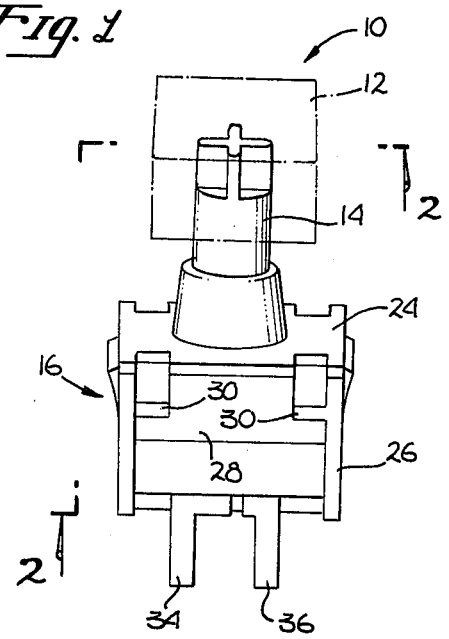
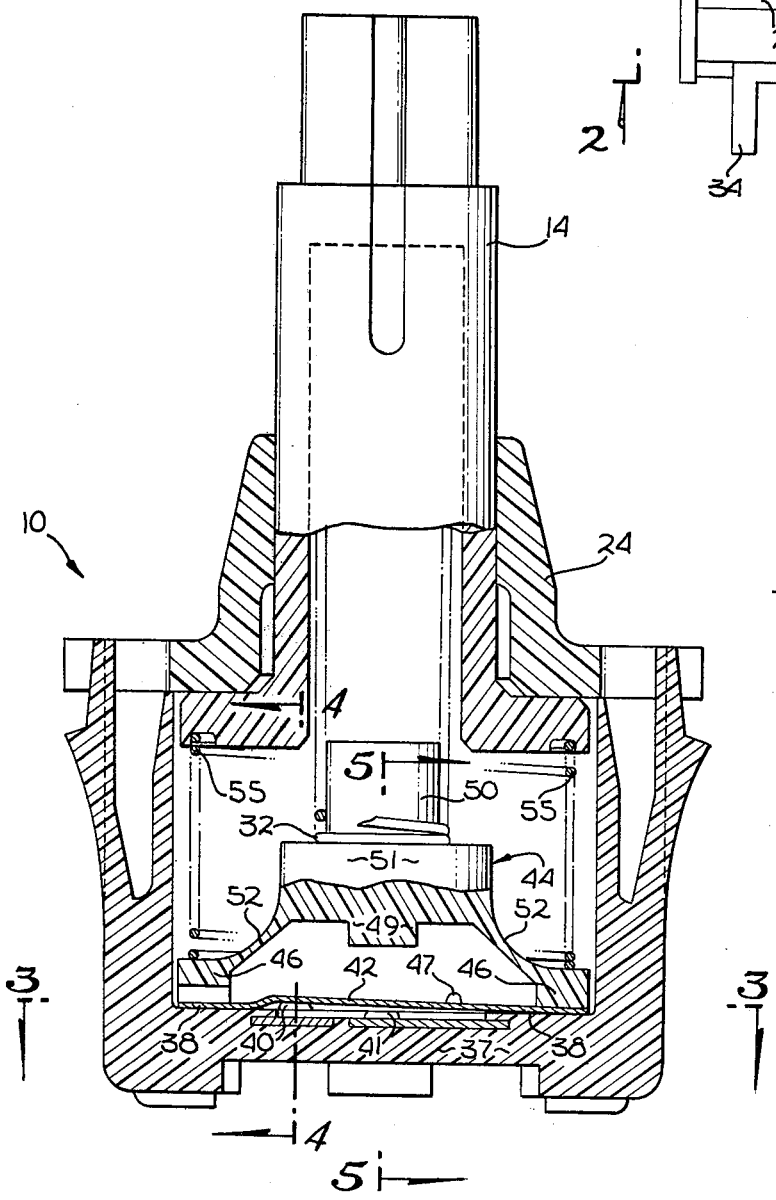
Fig. 2

KEYBOARD SWITCH

BACKGROUND OF THE INVENTION

1. Field of the Invention

The invention relates to electrical switches, particularly those switches used in computer keyboard applications.

2. Prior Art

In the computing industry, it is quite common to enter data into a computer by means of a keyboard. Typically, the keyboard is comprised of a plurality of discrete switch assemblies coupled to a printed circuit board having circuit pathways or contacts thereon. Upon depressing or activating a switch disposed on the keyboard, an electrical contact is achieved and appropriate data is thereby entered by the user.

As a result of the heavy and continuous demand placed on keyboard switches by frequent use, switch assemblies of this type must be highly reliable and yet cost effective. Numerous attempts to achieve a low cost but reliable keyboard switch have been made in recent years. For example, one common type of switch assembly provides electrical contacts spaced apart on the base of the switch housing. Upon depressing the key, an actuator incorporating a circular conductive pad disposed within the central portion of the structure of the actuator is forced downward and across the electrical contacts, thereby achieving an electrical connection. The use of a conductive pad disposed within the actuator requires that a shunt across at least two separate and distinct electrical contacts must occur in order to activate the switch. However, switches of this type do not achieve the desired level of reliability since by depressing the key off-center, it is possible that the circular conductive pad may not physically contact each spaced apart contact and thereby fail to provide an electrical coupling.

In addition, switches which incorporate an actuator of the type described above do not provide sufficient tactile sensation to alert the user when electrical contact occurs. Thus, both speed and efficiency are typically sacraficed when using keyboard switches known in the prior art, inasmuch as the user must fully depress each switch in order to be certain that proper electrical contact has been achieved.

As will be disclosed below, the present invention provides a simple but highly reliable and cost effective keyboard switch assembly which overcomes the inherent disadvantages of the prior art devices.

SUMMARY OF THE INVENTION

An improved switch assembly is disclosed, having particular application as part of a key in a computer keyboard. The switch includes first and second pairs of spaced apart electrical contacts on the base of the switch housing, the first contact pair extending above the second. A conductive and resilient diaphragm is disposed over both pairs of contacts, physically contacting only the first. A deformable generally bell shaped actuator member is disposed over the diaphragm, the walls of the actuator member taper in thickness so as to buckle upon the application of a known vertical force on the upper portion of the member. A keystem is slidably mounted for longitudinal movement within the housing above the actuator member. A user activates the switch by depressing a keycap mounted to the keystem, deforming the actuator member downward and forcing the diaphragm against the second contact pair, thereby completing a circuit. Biasing means are provided to urge the keystem upward and for providing resistance to the depression of the key by a user.

BRIEF DESCRIPTION OF THE DRAWINGS

FIG. 1 is a perspective view of the present invention.

FIG. 2 is a sectional view taken along line 2—2 of FIG. 1.

DETAILED DESCRIPTION OF THE INVENTION

An improved switch assembly having particular application as part of a key in a keyboard is disclosed. In the following description for purposes of explanation, specific numbers, dimensions and materials etc., are set forth in order to provide a thorough understanding of the present invention. However, it will be apparent to one skilled in the art that the present invention may be practiced without these specific details.

Referring now to FIG. 1, a switch 10 is shown. It will be appreciated from the discussion which follows that although switch 10 is particularly adapted for use in keyboards, the switch may be utilized in virtually any application requiring the use of a self-contained modular momentary switch. Typically, switch 10 includes a keycap 12 (shown in outline form) on which indicia, for example alphanumeric characters, may be applied.

Figure 7:
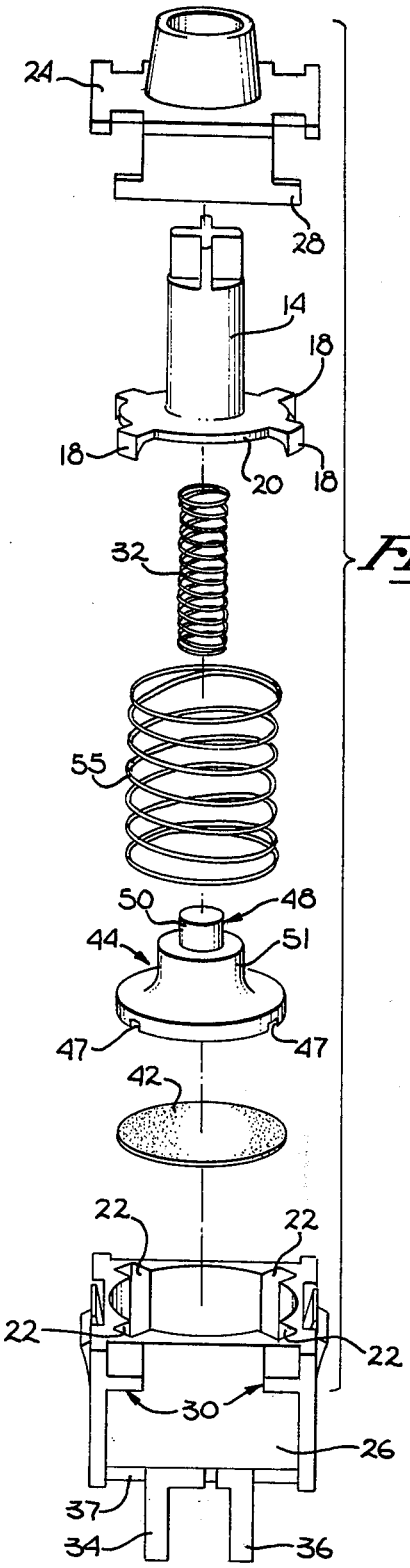
FIG. 7 is an exploded view of the present invention.

The keycap 12 is mounted on a keystem or actuating member 14. As illustrated in FIGS. 2 and 7, keystem 14 is slidably moveable vertically within a housing 16, and is preferably prevented from rotating or moving off-center by guide means such as tongues 18 integrally formed with a lower shoulder 20 of keystem 14, and positioned in channels 22 of housing 16, as best shown in FIG. 7. Housing 16 is comprised of a cover cap 24 and a body 26. In an assembled configuration, cover cap 24 and body 26 matingly engage and are held in place by press snap members 28 which during assembly snap over ridges 30 located on the exterior surface of the housing body 26. Housing 16 may be constructed of any suitable non-conductive material, for example plastic, nylon or the like. The upper limit of movement of keystem 14 is limited to the point where shoulder 20 physically contacts the interior surface of cover cap 24. Keystem 14 is partially hollow and retains inner spring 32, which as will be described, provides in part a biasing force to urge keystem 14 upward.

Figure 3:
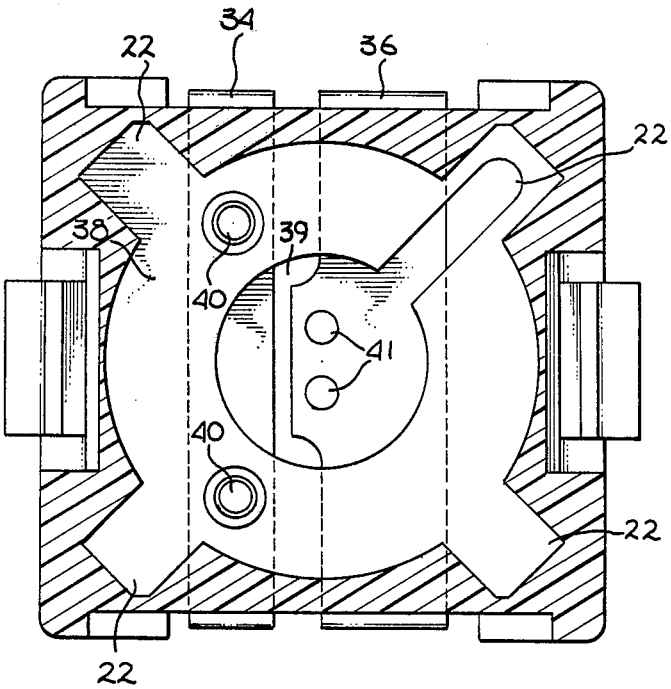
FIG. 3 is a plan view along line 3—3 of FIG. 2 illustrating the electrical conductive strips and contacts of the present invention.

Referring now to FIG. 3, the present invention incorporates parallel spaced apart conductive strips 34 and 36. The conductive strips are insert molded into the base 37 of housing body portion 26. Conductive strip 34 includes a pair of integrally formed raised static contacts 40 which extend upward from the surface of the base 37. Similarly, conductive strip 36 includes a pair of integrally formed raised active contacts 41 which although extend upward, do not extend to the height of the static contacts. It will be apparent from the discussion which follows that although two pairs of integrally formed contacts are used, the number of contacts may vary depending on the internal configuration of switch 10.

During the molding process, static contacts 40, active contacts 41, and a generally circular area 39 within the central portion of base 37 are not covered by the housing material. As illustrated in FIG. 3, portions of both conductive strips 34 and 36 are left exposed, and are recessed below an insulative lower surface 38 of housing material. The height of active contacts 41 are sized such that the contacts do not extend upward and beyond the level of the lower surface 38 of the housing base. The techniques of insert molding as well as the fabrication of switch housings are well known in the art, and will not be set forth in any further detail in this description.

Figure 4:
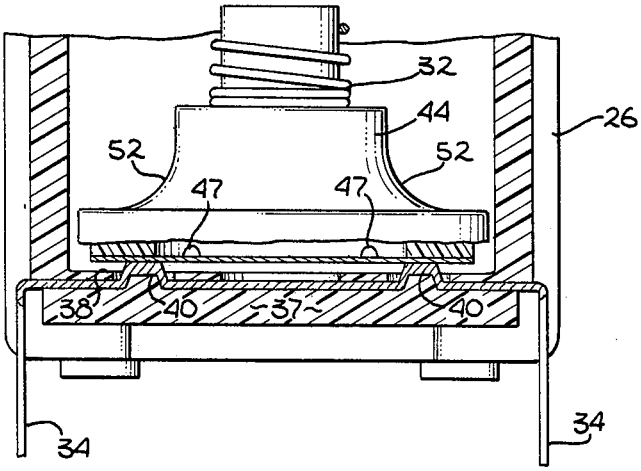
FIG. 4 is a sectional view along line 4—4 of FIG. 2 illustrating the static electrical contacts and snap actuator member of the present invention.
Figure 5:
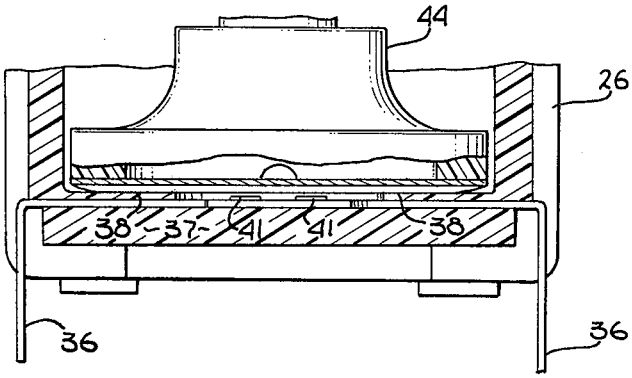
FIG. 5 is a sectional view along line 5—5 of FIG. 2 illustrating the active electrical contacts and snap actuator member.

As illustrated best in FIGS. 1, 4, and 5, conductive strips 34 and 36 extend beyond the walls of housing 16 and each form a pole of a switching circuit. In keyboard or other applications where switch 10 is mounted on a printed circuit board or the like, each conductive strip is typically bent downward as shown in FIG. 1, to permit switch 10 to be coupled to other elements in a circuit. In the presently preferred embodiment each conductive strip extends outward on opposite sides of housing 16 and forms two leads. The use of two leads for each pole of switch 10 reduces the number of jumper connections which must be used when mounting the switch in a keyboard array.

Referring once again to FIG. 2, a conductive and resilient diaphragm 42 is disposed substantially over lower surface 38. Although in the presently preferred embodiment diaphragm 42 is generally circular, it will be appreciated from the discussion which follows that the particular shape of the diaphragm may vary depending upon the internal dimensions of the housing 16. Diaphragm 42 physically contacts and is in part supported by static electrical contacts 40 which extend above lower surface 38 and active contacts 41. That portion of diaphragm 42 which is not supported by the static contacts rests on the insulative lower surface 38. It will be apparent that diaphragm 42 does not naturally contact active contacts 41 nor any other portion of the conductive strip 36 exposed within the generally circular area 39. As will be discussed, upon the depression of keycap 12 by a user, diaphragm 42 is forced into physical contact with the conductive strip 36, particularly active contacts 41, thereby electrically coupling the conductive strips and closing switch 10.

In the presently preferred embodiment, conductive diaphragm 42 is composed of a carbon impregnated silicone rubber, however, it will be appreciated that any suitable conductive element may be used in place of the impregnated rubber. In practice, it has been found that a diaphragm thickness of approximately 10 mils provides optimized resiliency and bounce back. However, the thickness of diaphragm 42 may vary depending on the particular application which switch 10 is to be applied to. In addition, diaphragm 42 may be composed of a thin and elastic metal, such as for example, brass, stainless steel or the like, for use in situations where the resistivity of the preferred rubber diaphragm is not compatible with the particular circuit which it forms a part of.

With reference to FIGS. 2 and 7, a resilient and generally bell shaped snap actuator member 44 is disposed substantially over diaphragm 42. As shown in the drawings, actuator member 44 includes a rim 46 with air vents 47 spaced circumferentially around the rim and passing into the interior of the bell shaped actuator member. The rim 46 is biased against the outer circumference of diaphragm 42 to hold the diaphragm stationary and somewhat taut. A core pin 48 is integrally formed with the central portion of the main body 51 of the actuator member. The core pin is positioned such that when switch 10 is in an assembled configuration, core pin 48 is disposed generally above active contacts 41. In the presently preferred embodiment, the core is generally cylindrical and extends axially through the main body portion of the actuator member 44. The core 48 includes an engagement nub 49 within the bell shaped actuator member, and an upper nub 50 extending above the main body 51 of snap actuator member 44.

As best shown in FIG. 2, actuator member 44 includes sidewalls 52 of tapering thickness. The walls taper in thickness so as to have a minimum thickness generally at the midpoint of the sidewalls. In other words, the thickness of sidewalls 52 progressively becomes less from the main body 51 of the actuator member to generally the midpoint of each wall. Similarly, the thickness of the sidewalls 52 progressively becomes thicker from the midpoint of the walls to the rim 46. The tapering of side walls 52 allows actuator member 44 to deform in a snap through action once a predetermined force is exerted along its longitudinal axis. The snap action is provided by the buckling of side walls 52 generally at the aforementioned point of minimum thickness. It will be appreciated that as a result of the tapered design of the sidewalls, until the predetermined force is exerted on actuator member 44, substantially no deformation of the member will occur. However, once the predetermined force is achieved, the sidewalls will collapse in essentially one continuous motion thereby vertically deforming actuator member 44. As will be presently discussed, the deformation of actuator member 44 forces diaphragm 42 to physically contact active contacts 41 thereby closing switch 10. The force required to collapse the sidewalls may be varied by altering the minimum thickness and tapering of the sidewalls.

Referring once again to FIGS. 2 and 7, inner spring 32 as previously disclosed is substantially retained within the central hollow portion of keystem 14. One end of inner spring 32 is disposed around the upper nub 50 of the core pin 48. An outer spring 54 is disposed between the lower surface of shoulder 20 of keystem 14 and the upper surface of the rim 46, as shown in FIG. 2. As will be discussed, springs 32 and 55 provide a biasing means to bias the keystem upward and retain the rim 46 in contact with the outer circumference of diaphragm 42. In addition, inner spring 42 provides the requisite coupling between the keystem and the actuator member needed to translate the depression of the keycap 12 by a user into actuation of switch 10, thereby completing a circuit.

Once assembled in the order depicted in FIG. 7, switch 10 may be coupled to other electrical elements to form a part of a circuit. As shown in FIG. 4, rim 46 of contact member 44 is supported in part by static contacts 40, thereby insuring that diaphragm 42 physically engages the static contacts. Similarly, with reference to FIGS. 2 and 5, it will be apparent that diaphragm 42 does not physically contact active contacts 41 and in fact is held relatively taut over the exposed recessed area 39 of the housing base.

Switch 10 is illustrated in FIG. 2 in an inactivated state. In operation, a user desiring to close switch 10 and thereby enter data, depresses keycap 12 forcing keystem 14 downward. The downward motion of keystem 14 compresses both the inner and outer springs as well as the bell shaped actuator. As will be appreciated by the above discussion relative to the structure of switch 10, the force exerted on keystem 14 is similarly exerted on snap actuator member 44 which rests below both springs. Specifically, the force translated into the outer spring 55 is exerted on the rim of the actuator member, thereby forcing the rim against diaphragm 42 preventing its movement and increasing its tension over the exposed area 39. Similarly, the force which is translated into the inner spring 32 is exerted on the main body 51 of the actuator member. As previously disclosed, the sidewalls of the contact member are designed to buckle upon the application of a predetermined force. Thus, despite the continued depression and downward movement of keystem 14, until the force exerted on actuator member 44 equals a predetermined design force, there will be little deformation of the actuator member.

Figure 6:
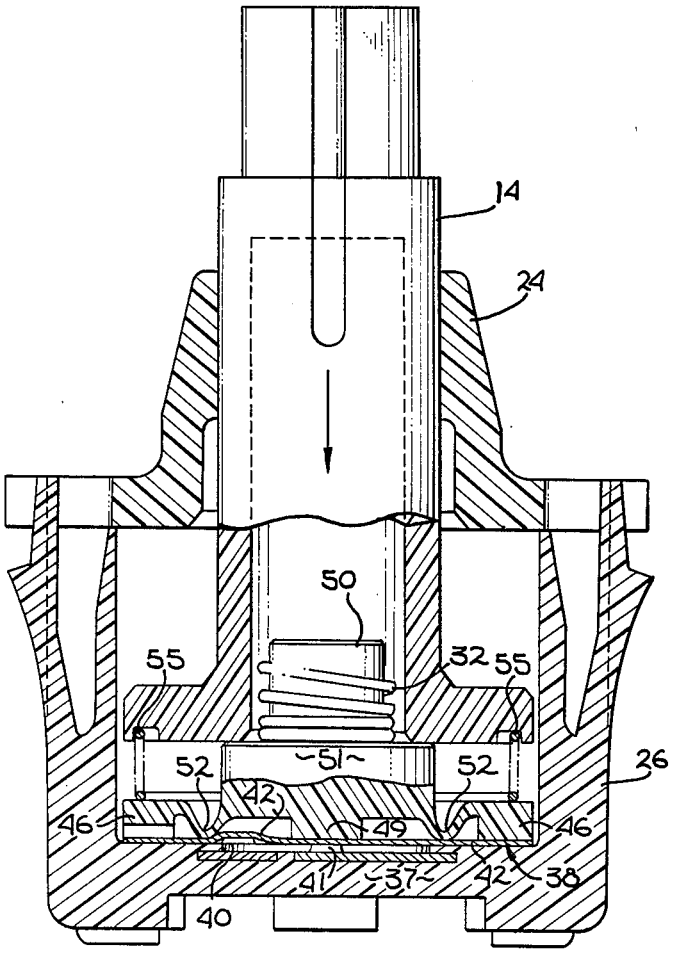
FIG. 6 is a sectional view along line 2—2 of FIG. 1 illustrating the present invention in an activated state.

With reference to FIG. 6, switch 10 is shown in an activated closed position. The continued application of force by the user on keystem 14 will result in the deformation of sidewalls 52 once the applied force exceeds the aforementioned buckling force. The buckling of sidewalls 52 occurs in a quick snap through action alerting the user that sufficient force has been applied to close switch 10. The inner engagement nub 49 of actuator member 44 is driven downward once buckling occurs and engages the conductive diaphragm 42 forcing the diaphragm into physical contact with active electrical contacts 41, thereby achieving an electrical coupling between the conductive strips 34 and 36. As actuator member 44 deforms, air within the bell shaped member is forced out through vents 47 to assure that the compression of the air does not provide resistance to the downward motion and buckling. It will be appreciated that the aforementioned layout and design of conductive strips 34 and 36 and the lower surface 38, insures that electrical contact is achieved with each key stroke of switch 10. The further depression of the key by a user deforms the diaphragm additionally into further contact with the exposed areas of both conductive strips within the generally circular area 39.

It will be noted that once the user removes the applied force to the switch 10, outer spring 55 will once again bias keystem 14 upward, and inner spring 32 will extend into its unloaded state. Similarly, snap through actuator member 44 will, upon the removal of the applied force, snap back into its natural undeformed configuration.

Thus, an improved switch having particular application to computer keyboards has been disclosed. The use of a snap through actuator member provides a distinctive tactile sensation alerting the user when electrical coupling has been achieved. The switch is simple but highly reliable and provides a switch assembly heretofore not known in the art. Although the preferred embodiment of the invention has been described in detail, it is to be understood that various changes, substitutions, and alterations can be made therein without departing from the spirit and scope of the invention as disclosed above.

I claim:

1. An improved key switch assembly, comprising:

a housing including a base;

first and second spaced apart electrical contacts disposed on said base, said first contact extending above said second contact;

an electrically conductive resilient diaphragm disposed over said first and second contacts and in physical contact only with said first electrical contact;

a resilient and deformable actuator member disposed generally over said diaphragm, said diaphragm being held relatively taut over said first and second contacts by said actuator member;

actuator means for deforming said actuator member in response to the depression of said key by a user, the deformation of said actuator member forcing said diaphragm to contact said second electrical contact;

whereby an electrical coupling between said first and second contacts occurs upon the actuation of said key switch by a user.

2. The improved switch assembly of claim 1 wherein said actuator means includes a keystem slidably mounted for longitudinal movement within said housing.

3. The improved switch assembly of claim 2 further including biasing means for urging said keystem away from said actuator member and providing resistance to the depression of said key by said user.

4. The improved switch assembly as defined by claim 3 wherein:

said keystem is partially hollow;

said biasing means includes a first spring disposed within said hollow portion of said keystem, said first spring contacting an upper surface of said actuator member.

5. The improved switch assembly as defined by claim 4 wherein said biasing means further includes a second spring disposed between an upper surface of said actuator member and a shoulder of said keystem.

6. The improved switch assembly as defined by claim 5 wherein said actuator member further includes a core portion disposed within said actuator member substantially above said second contact to deform said diaphragm into engagement with said second electrical contact upon the depression of said key by said user.

7. The improved switch assembly as defined by claim 6 wherein said actuator member is bell shaped and includes side walls tapered in thickness so as to have a minimum thickness generally at the midpoint along the length of said side walls, to allow said side walls to buckle generally at the point of said minimum thickness when said actuator member is deformed by a predetermined force applied along its longitudinal axis.

8. The improved switch assembly as defined by claim 7, further including first and second leads extending through said housing and coupled to said first and second contacts, respectively, for coupling said switch assembly to a printed circuit board.

9. The switch as defined by claim 7 wherein said diaphragm is comprised of silicone rubber inpregnated with a conductive element.

10. The switch as defined by claim 7 wherin said diaphragm is comprised of a metal.

* * * * *